US006702206B2

(12) United States Patent
Wu

(10) Patent No.: US 6,702,206 B2
(45) Date of Patent: Mar. 9, 2004

(54) WATER ADJUSTABLE TRIGGER NOZZLES

(76) Inventor: Ming-Yen Wu, P.O. Box 487, Chang-Hua City (TW), 500

( * ) Notice: Subject to any disclaimer, the term of this patent is extended or adjusted under 35 U.S.C. 154(b) by 0 days.

(21) Appl. No.: 10/429,752

(22) Filed: May 6, 2003

(65) Prior Publication Data

US 2003/0205627 A1 Nov. 6, 2003

(30) Foreign Application Priority Data

May 6, 2002 (TW) ..... 091206303

(51) Int. Cl.[7] ..... B05B 9/01

(52) U.S. Cl. ..... 239/526; 239/525; 239/569; 239/581.1; 239/581.2

(58) Field of Search ..... 239/525, 526, 239/569, 581.1, 581.2, 582.1

(56) References Cited

U.S. PATENT DOCUMENTS

| | | | | |
|---|---|---|---|---|
| 3,599,876 A | * | 8/1971 | Kyburg | 239/526 |
| 4,709,859 A | * | 12/1987 | Schulze et al. | 239/525 |
| 5,975,429 A | * | 11/1999 | Jezek | 239/526 |
| 5,984,207 A | * | 11/1999 | Wang | 239/526 |
| 6,425,538 B1 | * | 7/2002 | Heren | 239/526 |

* cited by examiner

*Primary Examiner*—Robin O. Evans

(57) ABSTRACT

A trigger nozzle includes a barrel connected to a handle and a nozzle head is connected to a front end of the barrel. A water adjustable device is received in the trigger nozzle and includes an operation shaft which controls the volume of water entering the barrel. A trigger is connected to the barrel so as to operate the operation shaft and a knob is connected to the operation shaft and located at a rear end of the barrel so that the user may rotate the knob to change the volume of the water entering the barrel without soaking his/her hand.

4 Claims, 9 Drawing Sheets

WATER ADJUSTABLE TRIGGER NOZZLES

FIELD OF THE INVENTION

The present invention relates to trigger nozzle which has a water adjustable device located away from the spout of the nozzle.

BACKGROUND OF THE INVENTION

A conventional trigger nozzle used for watering in garden generally includes a barrel with a handle connected thereto and a water hose is connected to an end of the handle so as to provide water in the barrel. A trigger device is pivotably connected to the barrel and can be pulled to allow the water to go out from a spout located at a front end of the barrel. In order to meet different needs, a water adjustable device is connected right beside the spout so that the user may operate the adjustable device to change the ways that the water goes from the spout. Nevertheless, due to the position of the adjustable device, the user's hand will be soaked when operating the device and this is not convenient for the user. In some area, the temperature of the water is just freezing which makes the user feel not comfortable.

The present invention intends to provide a trigger nozzle wherein the adjustable device is located at a rear end of the barrel so that the user's hand is away from the spout while operating the device.

SUMMARY OF THE INVENTION

In accordance with one aspect of the present invention, there is provided a trigger nozzle which comprises a barrel connected to a handle in which a passage is defined. A tunnel is defined through an upper section of the handle and has a first partition communicating with the barrel and a second partition communicating with the passage. A trigger is pivotably connected to the barrel and a nozzle head is connected to a front end of the barrel.

A water adjustable device is received in the tunnel and includes an operation shaft which includes a first end which extends from the tunnel and is engaged with the trigger. A seal section of the operation shaft is rotatably received in the first partition and has a groove defined longitudinally in an outer periphery thereof. A second end is connected to the seal section and received in the second partition of the tunnel. An end cap is engaged with the tunnel and a knob is rotatably mounted to the end cap. A spring is mounted to the second end of the operation shaft and biased between the seal section and a connection member which securely receives a part of the second end of the operation shaft. The connection member is received in the end cap and connected to the knob.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
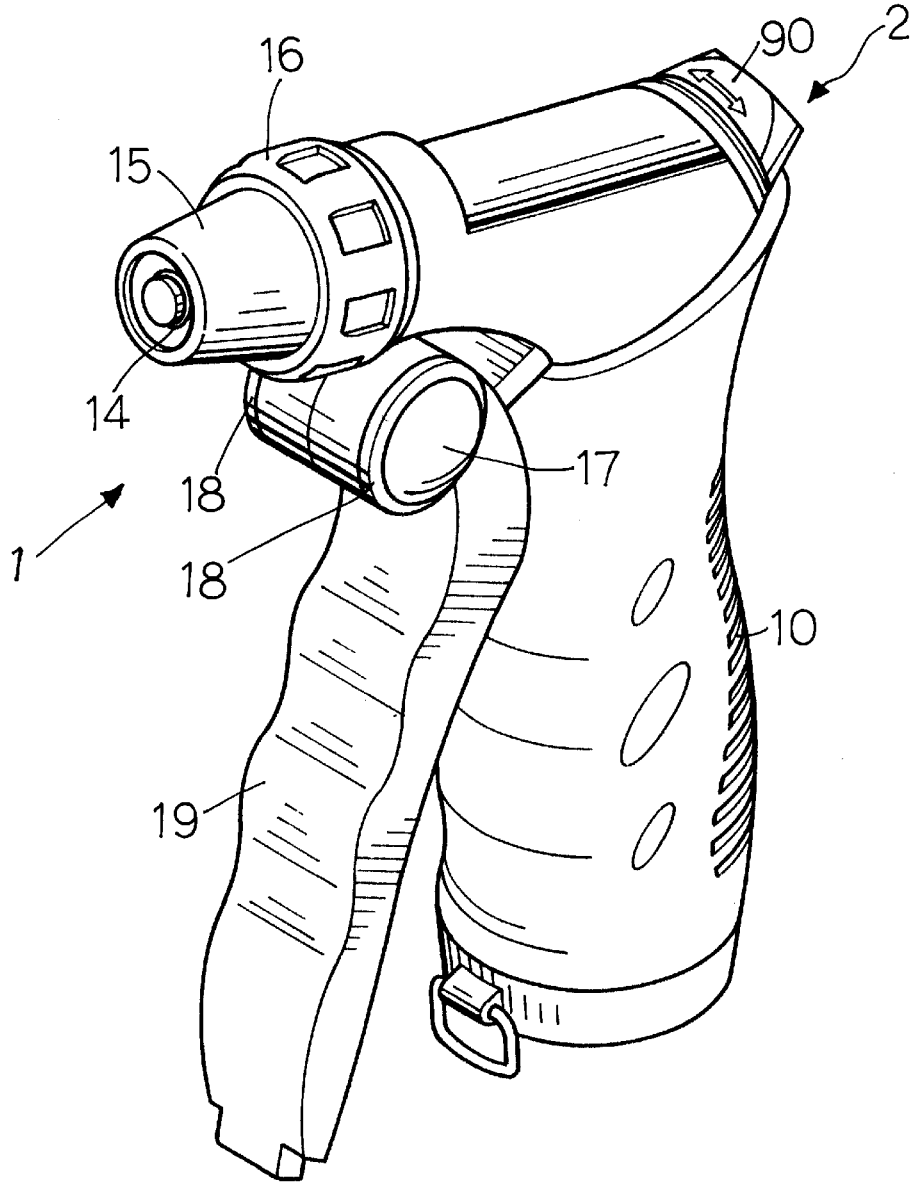
FIG. 1 is a perspective view to show the trigger nozzle of the present invention.
Figure 2:
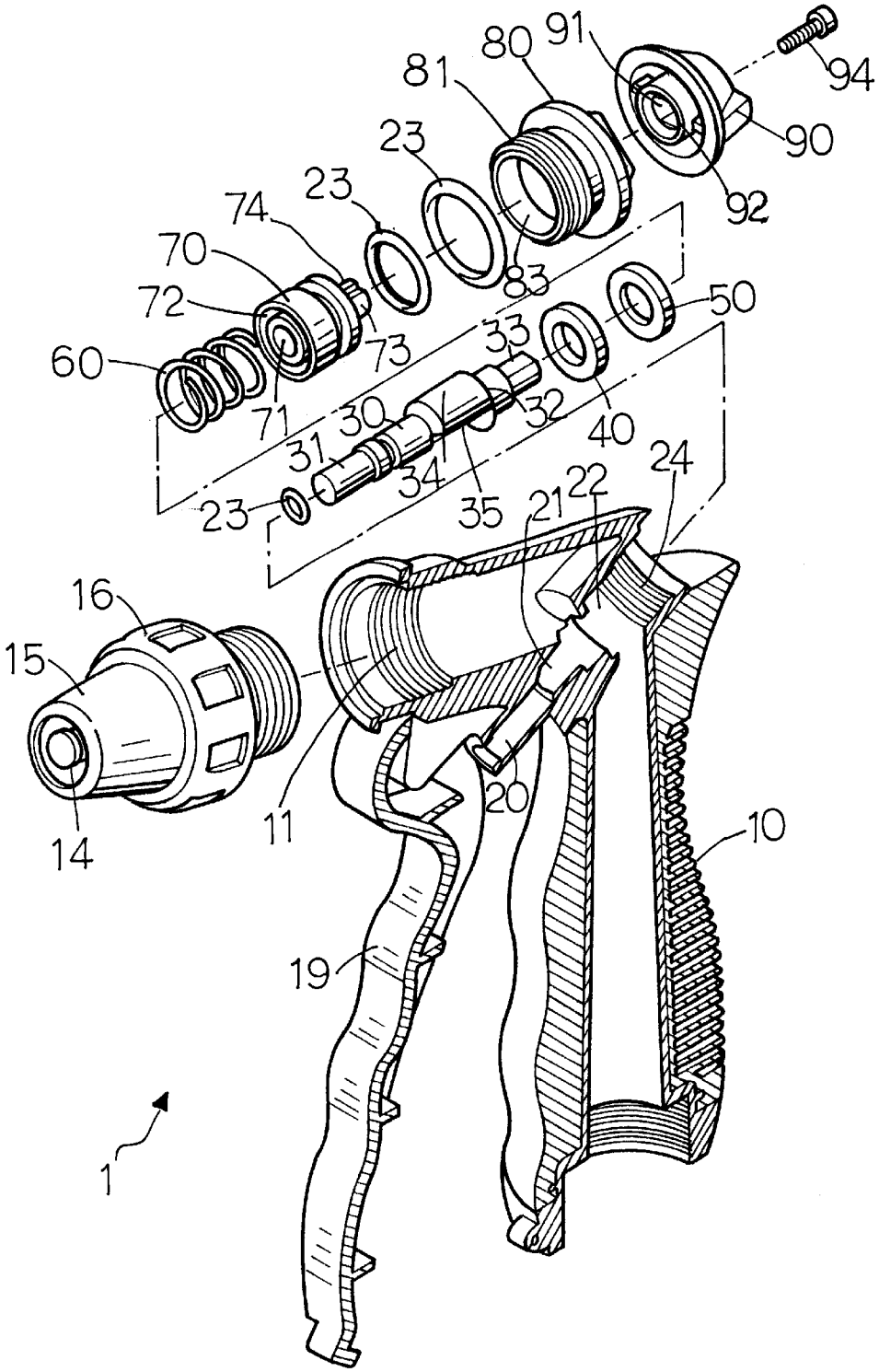
FIG. 2 is an exploded view to show the trigger nozzle and the water adjustable device of the present invention.
Figure 3:
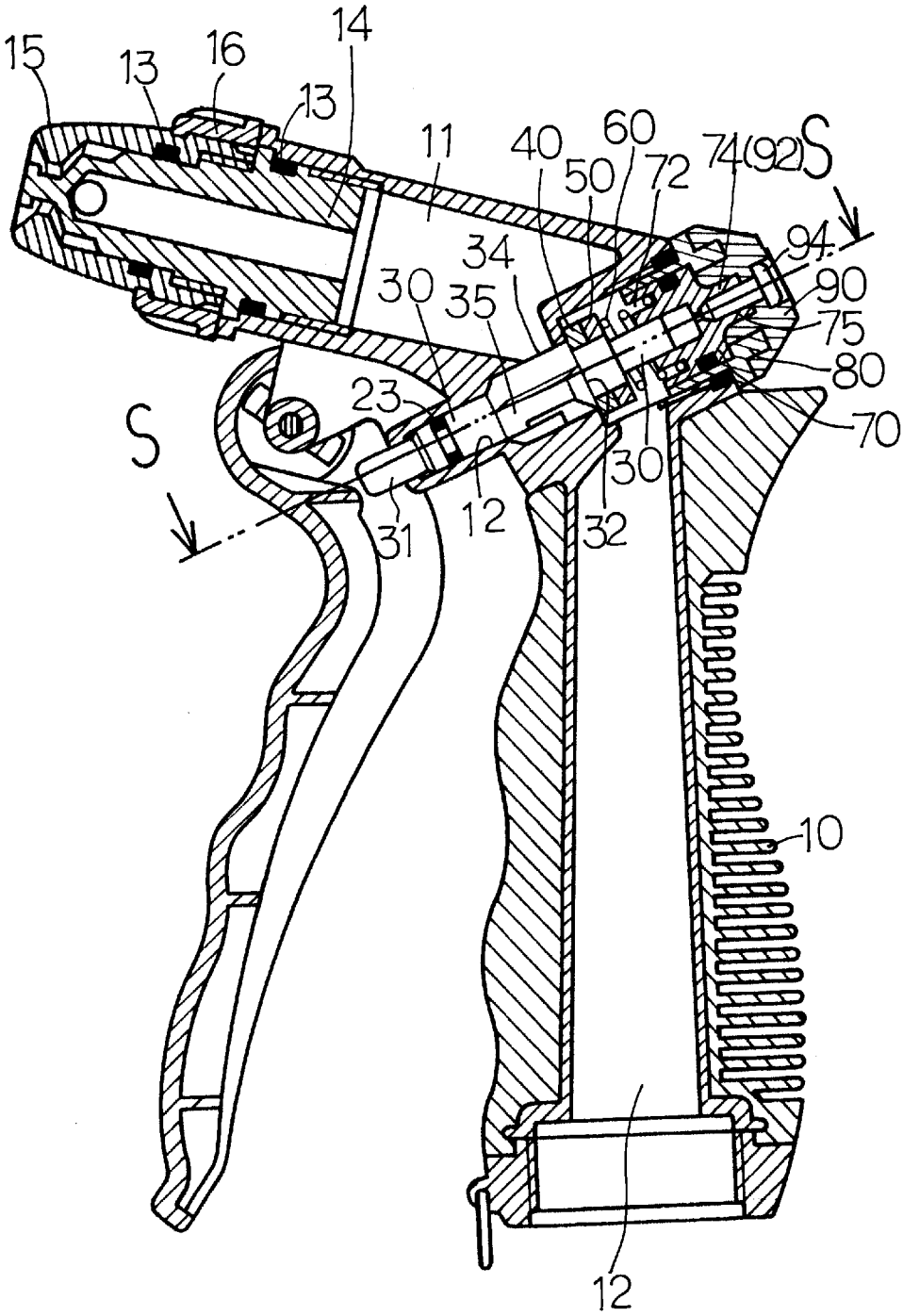
FIG. 3 is a cross sectional view to show the trigger nozzle of the present invention.
Figure 4:
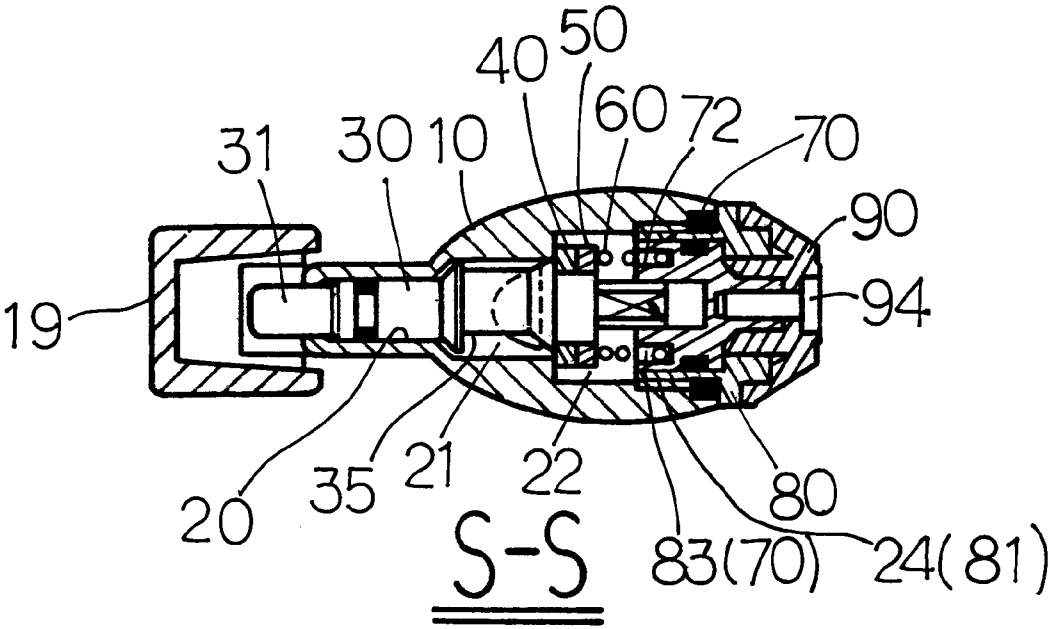
FIG. 4 is a cross sectional view taken along line S—S in FIG. 3.

Referring to FIGS. 1 to 4, the trigger nozzle 1 of the present invention comprises a barrel 11 connected to a handle 10 in which a passage 12 is defined. A trigger 19 is pivotably connected to the barrel 11 by a pin 17 covered by a trigger cover 18. A nozzle head 15 is threadedly connected to a front end of the barrel 11 and seals 13 are used to prevent leakage from the threads in connection portion. A rotatable collar 16 is mounted to the nozzle head 15 and a central piece 14 is movably received in the nozzle head 15.

A tunnel 20 is inclinedly defined through an upper section of the handle 10 and has a first partition 21 and a second partition 22. The first partition 21 communicates with an interior of the barrel 11 and the second partition 22 communicates with the passage 12 with which a hose for providing water is connected. A water adjustable device 2 is received in the tunnel 20 and includes an operation shaft 30 which is rotatably and movably received in the tunnel 20 with a seal 23 mounted thereto at the opening of the barrel 10. The operation shaft 30 includes a first end 31 which extends from the tunnel 20 and is engaged with the trigger 19. A seal section 34 of the operation shaft 30 is rotatably received in the first partition 21 and has a groove 35 defined longitudinally in an outer periphery thereof. A second end 33 is connected to the seal section 34 and received in the second partition 22 of the tunnel 20. A shoulder surface 32 is formed at an end of the seal section 34. A seal 40 and a ring 50 are mounted to the second end 33 of the operation shaft 30.

An end cap 80 has a threaded section 81 which is engaged with an inner threaded section 24 of the tunnel 20 and seals 23 are used to prevent from leakage. A connection member 70 securely receives a part of the second end 33 of the operation shaft 30, wherein the second end 33 of the operation shaft 30 includes a flat surface 33 and the connection member 70 has a hole 71 which has a flat surface in an inner periphery thereof so as to be engaged with the second end 33 of the operation shaft 30. The connection member 70 is received in a through hole 83 in the end cap 80 and has a tongue 73 extending therefrom which has a key 74. A knob 90 is rotatably mounted to the end cap 80 and has a hole 91 which has a key-way 92 defined in an inner periphery thereof so that the key 74 on the tongue 73 is engaged with the key-way 92 in the hole 91 of the knob 90. A bolt 94 extends through the knob 90 and is threadedly connected to a threaded hole 75 in the tongue 73 of the connection member 70.

A spring 60 is mounted to the second end 33 of the operation shaft 30 and biased between the ring 50 and the connection member 70 which has an annular groove 72 so as to receive an end of the spring 60.

Figure 5:
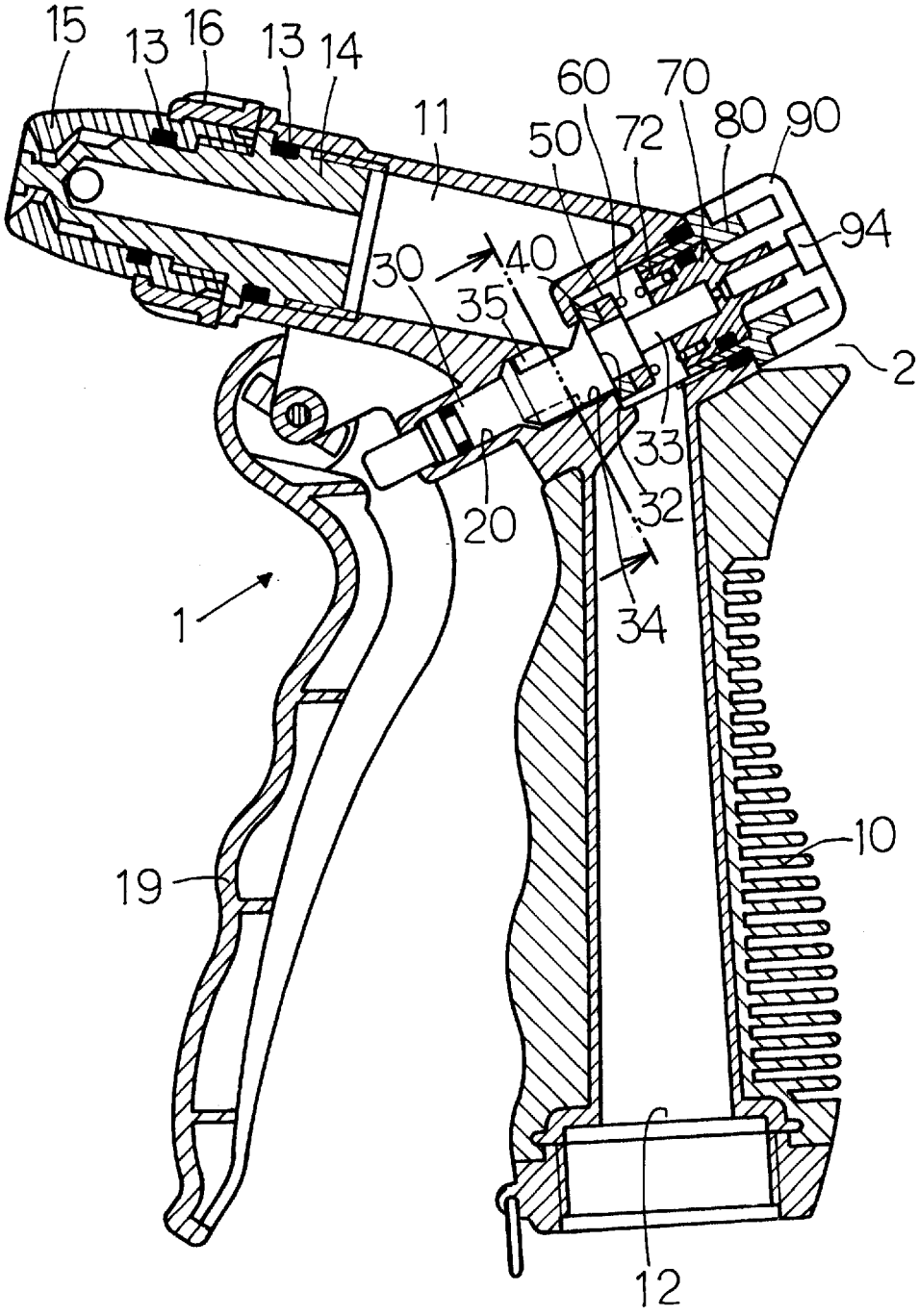
FIG. 5 is a cross sectional view to show the operation shaft of the trigger nozzle of the present invention is rotated an angle.
Figure 7:
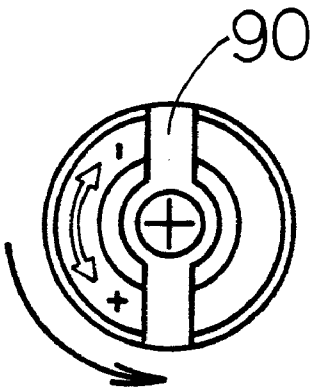
FIG. 7 shows the knob is rotated.
Figure 6:
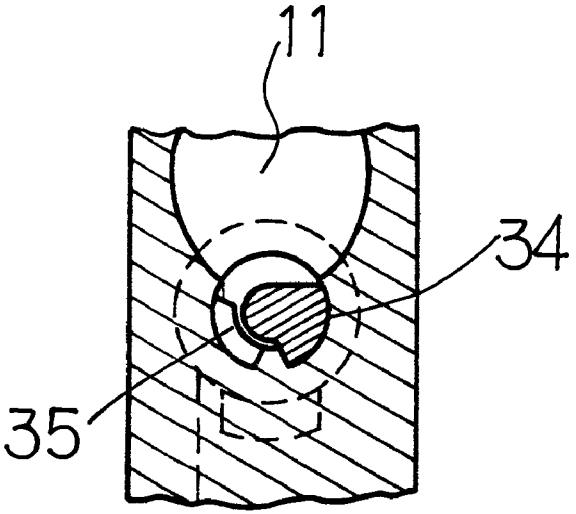
FIG. 6 is a cross sectional view to show the position of the groove in the seal section is changed.
Figure 8:
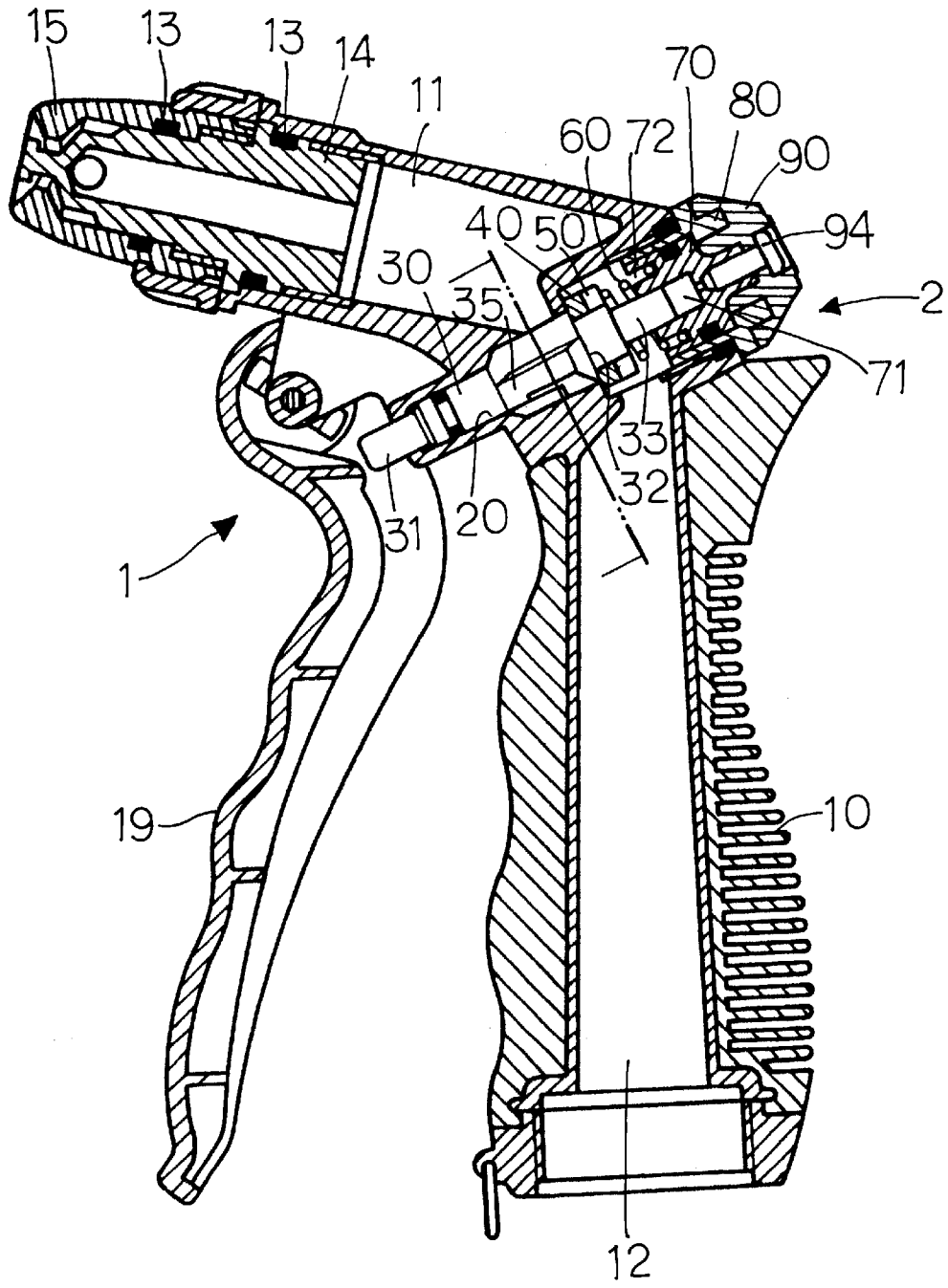
FIG. 8 is a cross sectional view to show the volume of water is adjusted to smallest scale.
Figure 10:
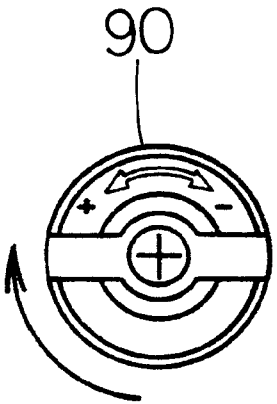
FIG. 10 shows the knob is rotated corresponding to FIG. 9.
Figure 9:
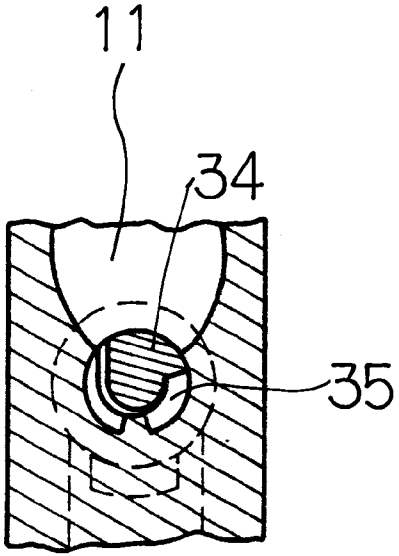
FIG. 9 is a cross sectional view to show the position of the groove in the seal section is changed corresponding to FIG. 8.
Figure 11:
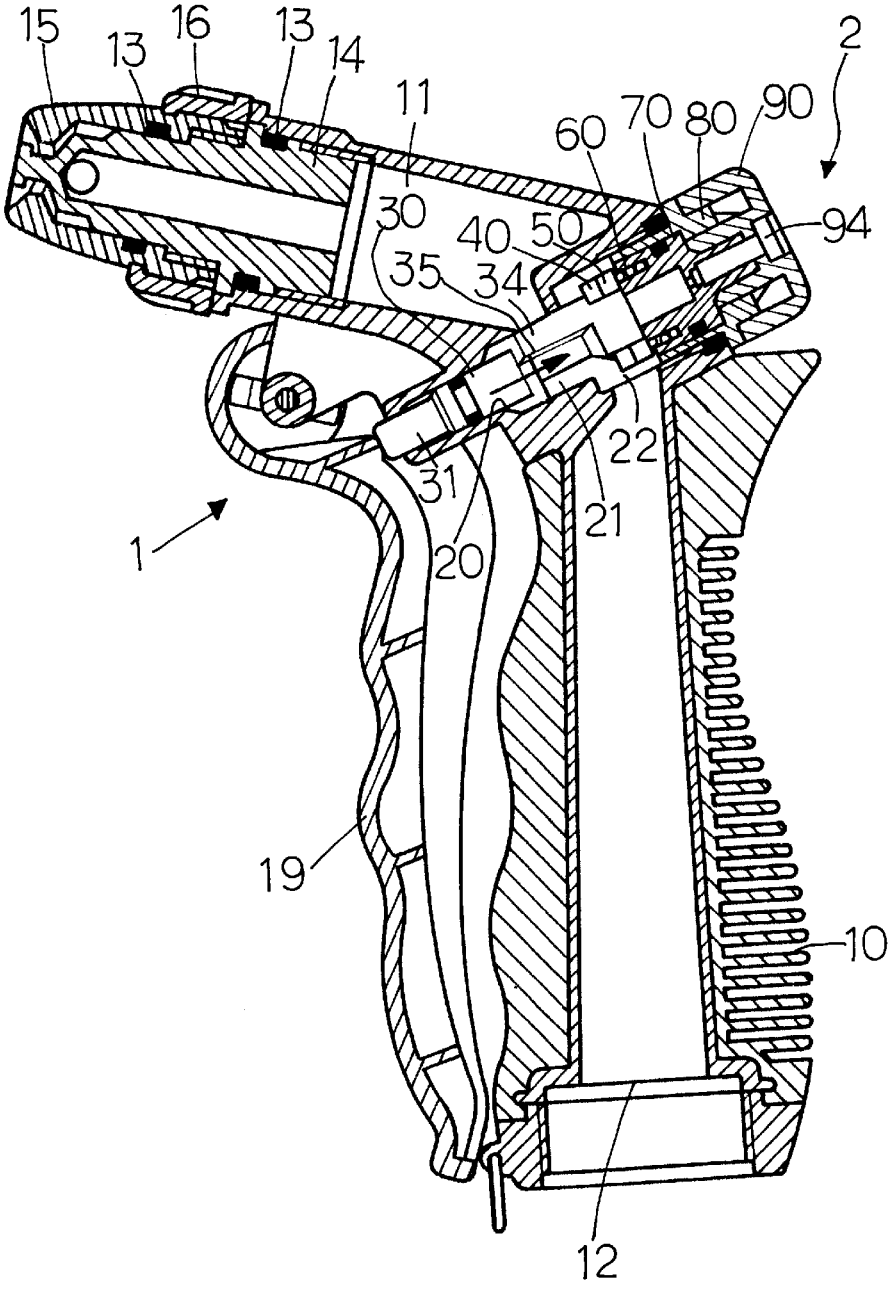
FIG. 11 shows the trigger is pulled.

Referring to FIGS. 5 to 7, when rotating the knob 90, the operation shaft 30 is co-rotated and the seal section 34 is rotated to position the groove 35 so that a large gap is defined in communication between the interior of the barrel 11 and the first partition 21. Therefore, a large amount of water enters the interior of the barrel 11. Referring to FIGS. 8 to 10, when rotating the knob 90 in opposite direction, the operation shaft 30 is co-rotated and the seal section 34 is rotated to position the groove 35 so that a small gap is defined in communication between the interior of the barrel 11 and the first partition 21. Therefore, only a small amount of water enters the interior of the barrel 11. Referring to FIG. 10, when pulling the trigger 19, the first end of the operation shaft 30 is pushed so that the seal 40 and the ring 50 are moved with the operation shaft 30 and water is allowed to enter the interior of the barrel 11.

It is noted that the position of the knob 90 is located at the rear end of the barrel 11 so that the user can operate the knob 90 without being soaked by the water coming from the nozzle head 15.

While we have shown and described the embodiment in accordance with the present invention, it should be clear to those skilled in the art that further embodiments may be made without departing from the scope of the present invention.

What is claimed is:

1. A trigger nozzle comprising:

a barrel connected to a handle in which a passage is defined, a tunnel defined through an upper section of the handle and having a first partition and a second partition, the first partition communicating with an interior of the barrel and the second partition communicating with the passage, a trigger pivotably connected to the barrel and a nozzle head connected to a front end of the barrel, and a water adjustable device received in the tunnel and including an operation shaft which is rotatably and movably received in the tunnel, the operation shaft including a first end which extends from the tunnel and is engaged with the trigger, a seal section of the operation shaft rotatably received in the first partition and having a groove defined longitudinally in an outer periphery thereof, a second end connected to the seal section and received in the second partition of the tunnel, a shoulder surface being formed at an end of the seal section, a seal and a ring mounted to the second end of the operation shaft, an end cap engaged with the tunnel and a knob rotatably mounted to the end cap, a spring mounted to the second end of the operation shaft and biased between the ring and a connection member which securely receives a part of the second end of the operation shaft, the connection member received in the end cap and connected to the knob.

2. The trigger nozzle as claimed in claim 1, wherein the second end of the operation shaft includes a flat surface and the connection member has a hole which has a flat surface in an inner periphery thereof so as to be engaged with the second end of the operation shaft.

3. The trigger nozzle as claimed in claim 1, wherein the connection member has a tongue which has a key and the knob has a hole which has a key-way defined in an inner periphery thereof so that the key on the tongue is engaged with the key-way in the hole of the knob.

4. The trigger nozzle as claimed in claim 1, wherein a bolt extends through the knob and threadedly connected to the connection member.

* * * * *